United States Patent [19]

Ahlström

[11] 4,194,612

[45] Mar. 25, 1980

[54] CONTROL MECHANISM FOR A VENDING MACHINE

[76] Inventor: Allan Ahlström, Mahults Herrgård, Simlängsdalen, Sweden, 31039

[21] Appl. No.: 909,570

[22] Filed: May 25, 1978

[30] Foreign Application Priority Data

May 26, 1977 [SE] Sweden ..... 7706160

[51] Int. Cl.[2] ..... G07F 7/08

[52] U.S. Cl. ..... 194/4 R

[58] Field of Search ..... 194/4 R, 4 D; 221/92, 221/2, 289

[56] References Cited

U.S. PATENT DOCUMENTS 4,046,242 9/1977 Ahlström ..... 194/4 R

*Primary Examiner*—Stanley H. Tollberg

*Attorney, Agent, or Firm*—Cantor and Singer

[57] ABSTRACT

A vending machine having a number of separate compartments, each blocked by a rotatable member has a control mechanism, which includes a member insertable in an opening. The proper member will release the blocking members and further includes a portion, where pin stamps operable by the rotation of the blocking members will put a mark. The control portion is formed like a body having transverse bores, each housing an axially displaceable stud, which is operable by a specific pin stamp, and is retainable in either of two axial positions.

7 Claims, 11 Drawing Figures

FIG. 10
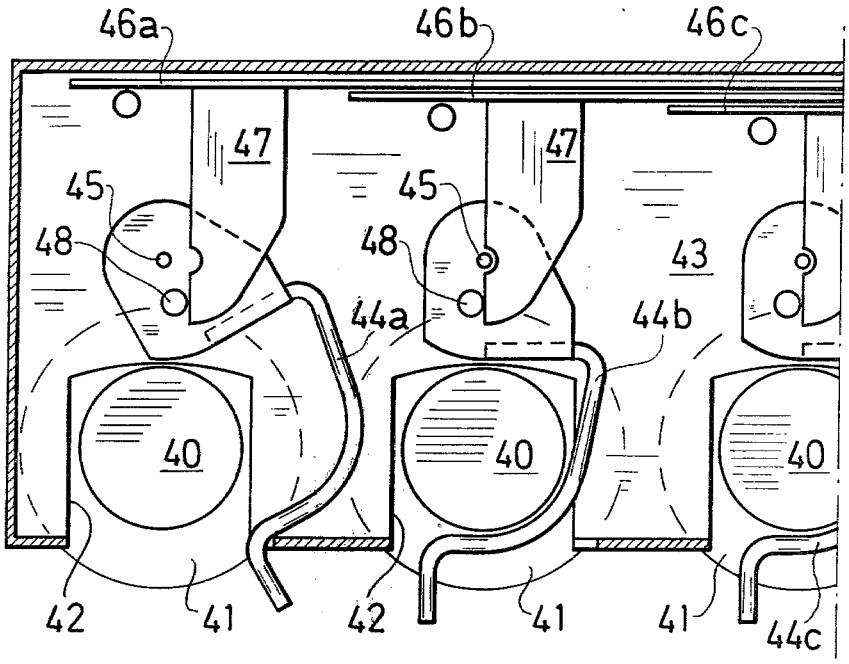
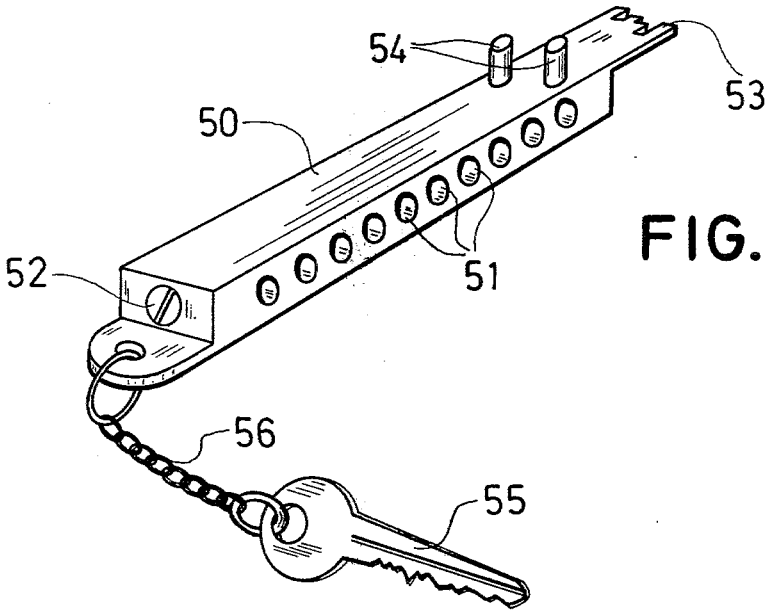
FIG. 11

CONTROL MECHANISM FOR A VENDING MACHINE

BACKGROUND OF THE INVENTION

Different types of vending machines have been proposed, where goods are displayed and are made available when a blocking member has been released.

Certain types are based upon coins being fed into a slot, but such machines are unsuitable on many occasions, especially when they cannot be kept under continuous surveillance. A sum of money collected in this way will always be an incitement to burglary.

Vending machines have also been proposed, where each withdrawal of an article causes an activity upon a control slip, which is introduced into the machine. The control slip may be pre-paid and a purchase means a reduction of the sum available, or the purchases are added up and are paid afterwards. Certain difficulties are involved in preventing unauthorized use of such machines.

The aim of the present invention is to design a release element in such a manner, that control of goods being removed from the machine is simplified.

CROSS-REFERENCE TO RELATED ART

In U.S. Pat. No. 4,046,242, the inventor describes a vending machine having a number of compartments, in which goods are displayed behind blocking members, and are made available by said blocking members being set free by the introduction of a release element into a mating opening in the machine, movement of a blocking member to permit removal of a certain piece of goods, by way of a linkage operating a pin stamp adapted to put a mark in a specific pattern upon a control portion of the release element.

SUMMARY OF THE INVENTION

The present invention aims at improving the control by forming the control portion of the release element as a box structure having a number of transverse bores in number and position mating with said pin stamps, each of said bores housing a stud adapted to be retained in either of two axial positions.

The opening in the machine may include a housing, enclosing the control portion of the release member, when the latter is introduced into the opening, the housing having guides for the pin stamps.

The control portion may be formed as a cylinder, rigidly connected to a rotatable key, being fitted between the key bit and the grip.

The control portion may attentively be formed as a substantially prismatic body being axially slidable into the opening, and carrying key portions performing the release action.

BRIEF DESCRIPTION OF THE DRAWINGS

FIG. 10 shows part of a vending machine having blocking members of a modified design, and FIG. 11 shows a further design of a control means.

DESCRIPTION OF SOME PREFERRED EMBODIMENTS

Figure 1:
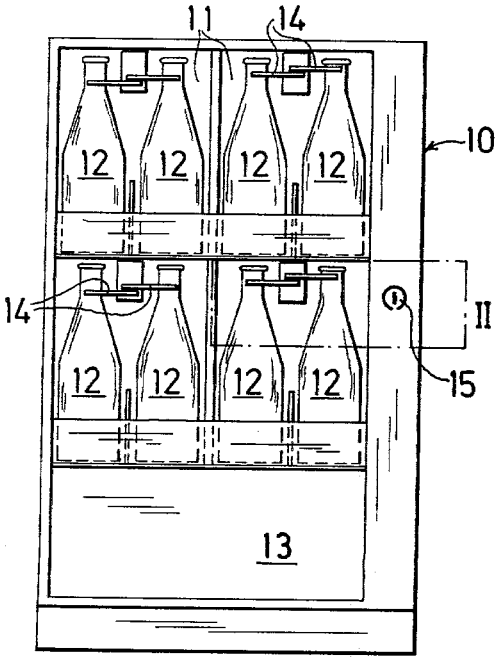
FIG. 1 shows a machine suited for vending bottled beverages.

FIG. 1 shows very schematically a vending machine 10 adapted for the sale of bottled beverages, and will be mounted in a hotel room or similar locality. The embodiment shown includes four groups of two compartments 11 arranged side by side, and each dimensioned to receive one bottle 12. A refrigerating machinery (not shown) may be fitted in a lower cabinet 13.

Each compartment may be blocked by means of a rotatable member 14, which is designed in such a manner that the bottle in the compartment cannot be removed until the associated blocking member has been released. Such release will be caused by the introduction and rotation of a key in a slot 15.

The key is, in the manner to be described below, provided with a control portion upon which linkages operated by the blocking members 14 will emboss a mark, on each occasion a blocking member 14 is rotated to permit withdrawal of a bottle. Each compartment will correspond to a certain spot upon the control portion, and it is thus possible for the person performing the control to read upon the key the number of bottles having been withdrawn, and also to calculate the sum of the purchases, even if the prices are different—say for the sake of simplicity that all bottles in the upper row have the same prices, while bottles in the lower row are more expensive.

When the vending machine is fitted in a hotel room the key to the room will preferably also operate the machine. It will then be possible to obtain a better control of the withdrawals than with older types of vending machines where the blocking is released by means of a control slip upon which the embossing is performed. For practical reasons the control slips cannot be shaped so as to suit individual machines, which means a possibility for unauthorized use.

Figure 2:
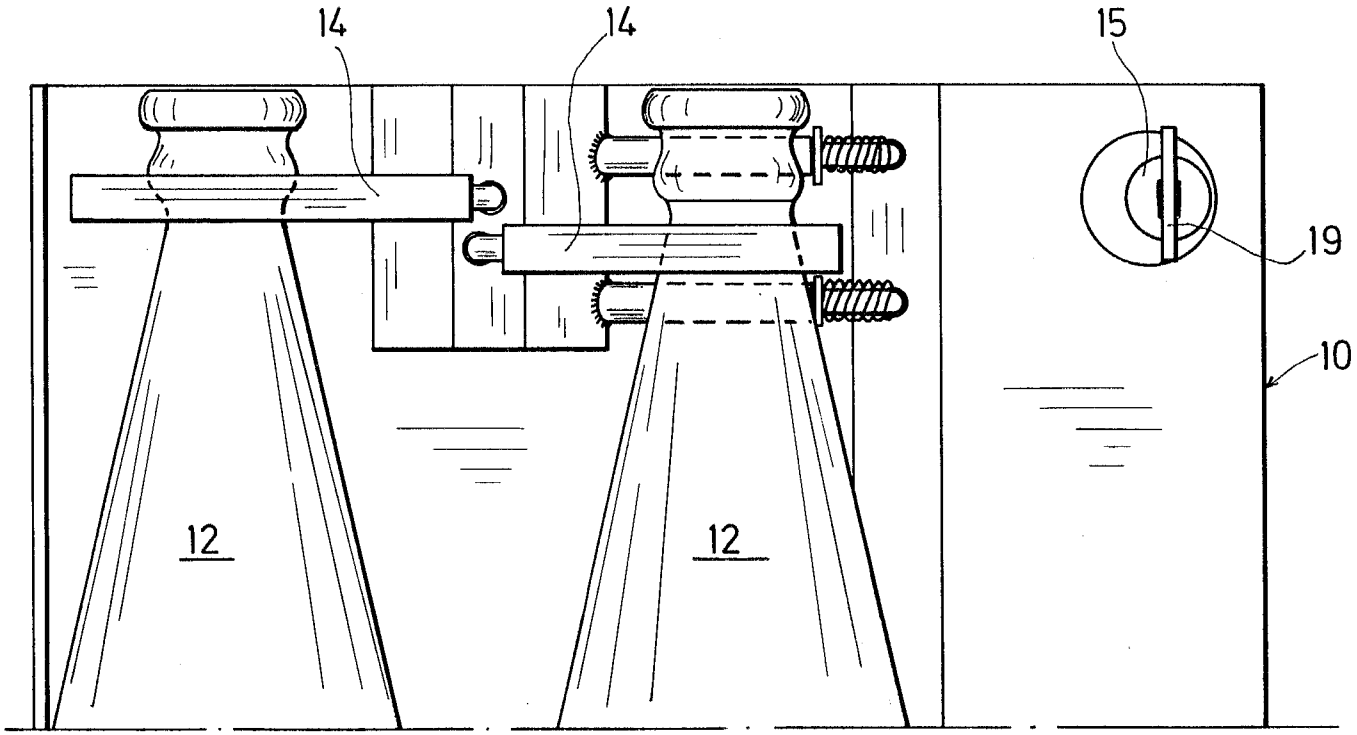
FIG. 2, on a larger scale, shows a detail of FIG. 1, framed-in at II of that figure.
Figure 3:
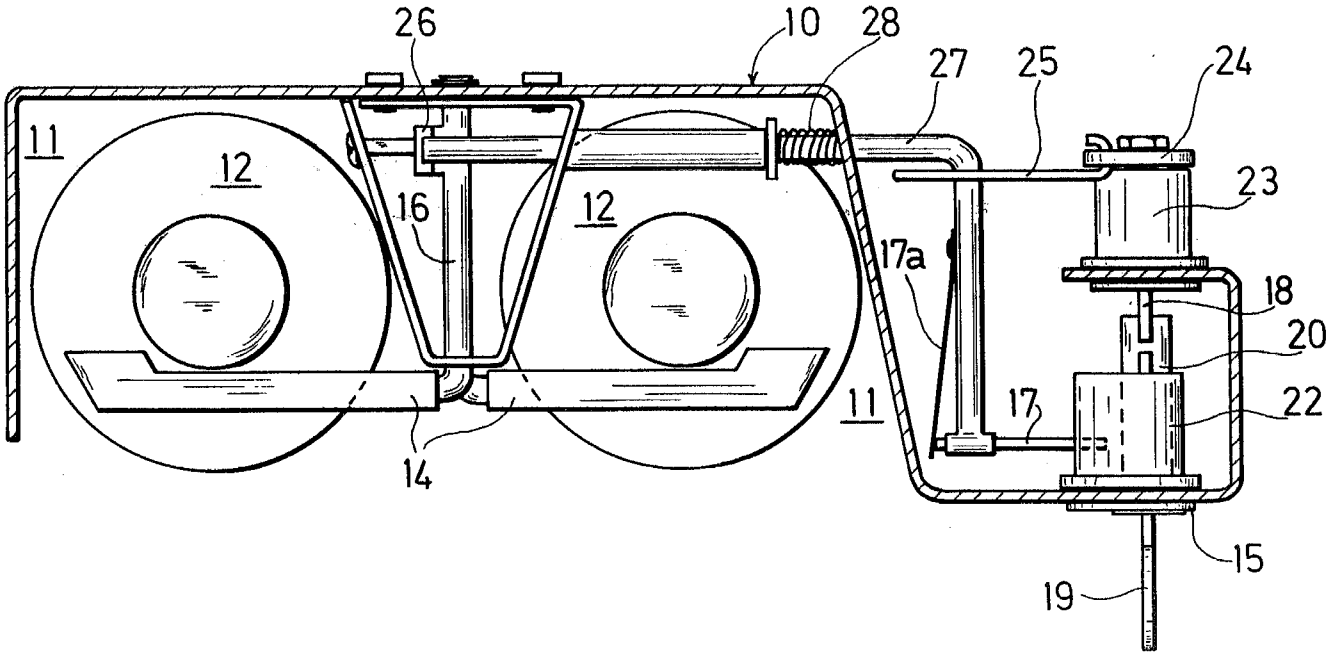
FIG. 3 shows a horizontal section through the part illustrated in FIG. 2.

FIGS. 2 and 3 show, on a larger scale, a portion of the vending machine 10 in elevation and in a horizontal section, respectively.

Each compartment 11 is formed with due consideration to the size of the bottle to be received, and the blocking member 14 extends outside of the neck of the bottle. Each member 14 is mounted upon a rotatable shaft 16, and this will operate an embossing pin 17, when being rotated.

Figure 4:
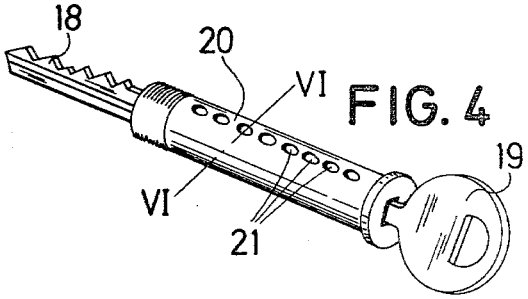
FIG. 4 shows a control means adapted to permit withdrawal of goods from the machine.

A key includes, as is shown in FIG. 4, a bit 18, a grip 19 and a control portion 20 fitted between the bit and the grip. The control portion is formed as a cylinder, which is rotatable together with the bit 18.

A number of bores 21 are provided in the control cylinder 20, each bore corresponding to a certain compartment, and the intention is that a pin stamp shall be introduced in a pertaining bore 21, upon rotation of the corresponding control member 14.

In conjunction with the key slot 15 there is in the first hand a cylindrical housing 22 for the control portion, the housing having guides for the pin stamps 17, and further a conventional locking cylinder 23 for the bit of the key. A lever 24 is attached to last mentioned cylinder.

In order to cause a releasing action the key will, in the conventional manner, be rotated a quarter of one revolution, and in doing so the bores 21 in the control means will be brought into alignment with the guides for pin stamps 17 in cylinder 22. Simultaneously, lever 24 attached to locking cylinders 23 will, by way of a link 25, cause a pulling action upon all linkages connected to control members 14, so these members will be released. This movement is, however, not so big, that pin stamps 17 will be brought into contact with the control portion 20.

Figure 7:
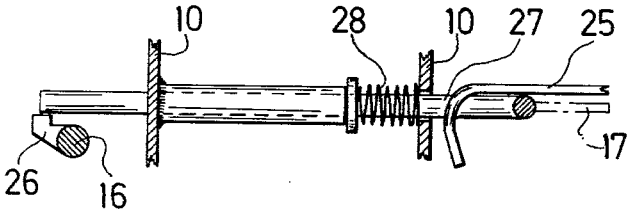
FIG. 7 shows a detail of the linkage between the rotatable blocking member and the embossing portion.

As is evident from FIG. 7, shaft 16 is provided with a cam 26. Link 25 will actuate an angular rod 27, one end of which, in blocking position, rests upon cam 26, and prevents rotation of shaft 16. The opposite end of rod 27 carries a pin stamp 17. There is a certain lost motion or play between link 25 and rod 27, which means that the rod will be displaced a short distance only during the quarter-of-a-revolution performed by the key.

The rod is biased by a spring 28 so it is maintained in its blocking position if it is not actuated by link 25. When rods 27 have been retracted somewhat by link 25, any cam 26 may be rotated by means of its associated blocking member 14 and shaft 16. The cam will then push rod 27 (to the right as shown in FIG. 7), whereupon pin stamp 17 is introduced into the control portion 20. The pin stamp 17 is axially displaceable in a bore at the end of the rod, and is biased by a leaf spring 17*a*, which is sufficiently strong to guarantee that the desired embossing action is performed, but will prevent an upsetting of the pin stamp, if the bore 21 should not have been brought into proper alignment with the pin stamp.

Each bore in the cylinder contains an axially displaceable stud 29, which is retarded by a spring loaded ball 30. When a stud has been pushed inwards by a pin stamp 17, ball 30 will snap into a circumferential groove 31 in the stud, and this can then not be brought back to its outward activity. A pushed-in stud will thus show that a bottle has been removed from a pertaining compartment.

The bit 18 of the key is preferably permanently attached to cylinder provided with a rod shaped extension 32, which at its end remote from the grip is provided with a projection 33.

An axially running slot is provided in cylinder 30, diametrically opposite to bores 21 for the reception of rod 32. When this rod is retracted, or pushed into the slot, studs 29 will be returned to their outward position by means of projection 33. The rod is locked to the cylinder by means of a special tool, or in any other convenient manner, so it cannot be removed by an unauthorized person.

Figure 8:
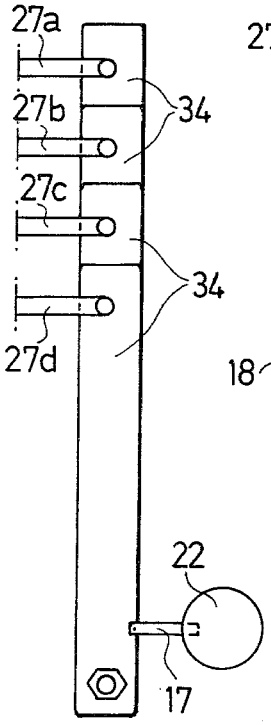
FIG. 8 shows a further part of the embossing mechanism.
Figure 9:
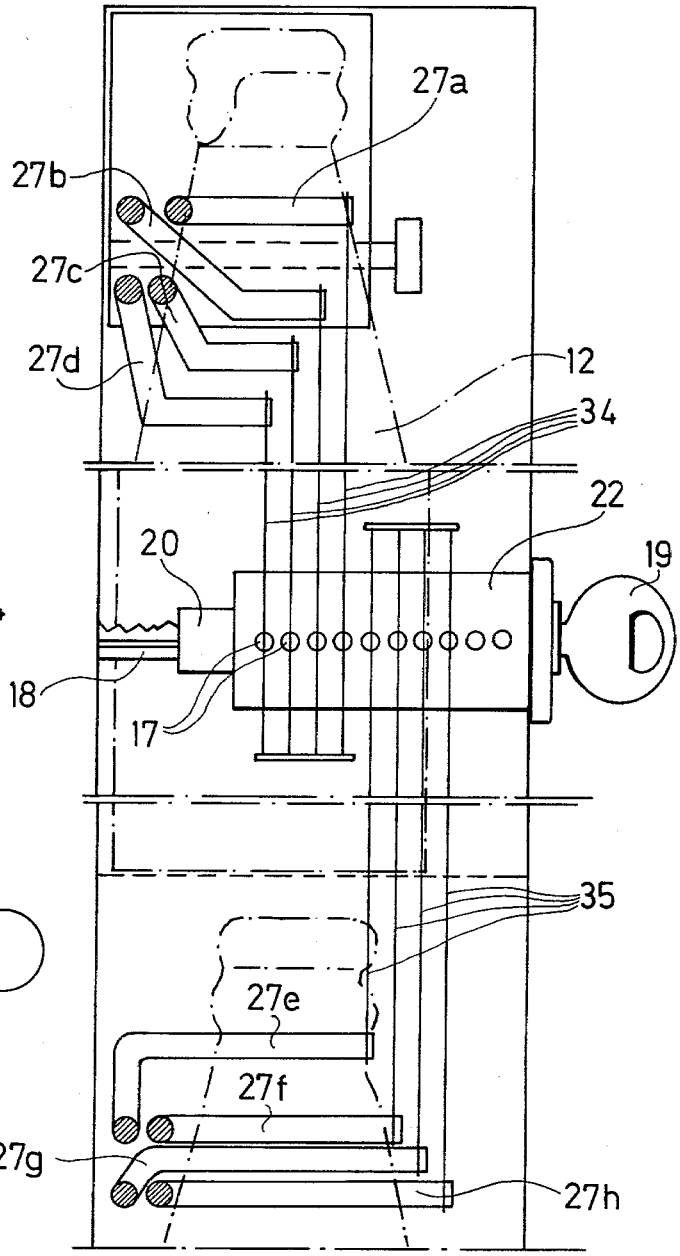
FIG. 9 illustrates how the components shown in FIG. 8 may be arranged in conjunction with the control means.

FIG. 3 shows, for the sake of simplicity, that rod 27 reaches directly to cylinder 22, which will be difficult when several rods are involved. FIGS. 8 and 9 show how the transfer of movements may be solved at a machine having eight compartments.

Rods 27*a–d* from the upper compartments are connected to swinging links 34 of different lengths, pivotable at their lower ends, the ends of the connected rods being bent in two planes. A similar set of links 35, pivotable at their upwards ends, are connected to rods 27*e–h* extending from blocking members at the lower compartments.

In the embodiment shown the bores 21 are located in a single row. With a vending machine having several compartments two rows of bores, arranged at an angular distance from each other, may be provided, so they are brought into alignment with corresponding pin stamps 17, after a required turning of the locking cylinder 23.

The vending machine shown is adapted for bottles, but it is evident that other types of goods, suitably packed, may be purveyed. The size of the compartments and the shape of the blocking members will then have to be modified with respect to the size and shape of the goods displayed.

A control portion may alternatively be formed as an elongate, substantially prismatic body having a front end provided with indentations or projection simulating a key bit and having a row of stud containing bores at least along one of its sides. Such control portion is adapted to be pushed axially into the machine, and will release the blocking members when brought to a definite position, where simultaneously the bores will be reached by the pin stamps.

In a hotel the control portion may be fitted as a pendant to the room key, and may bear the room number, the name of the hotel, or other identification.

Figure 5:
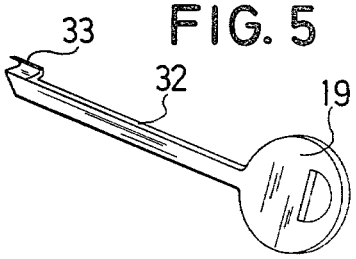
FIG. 5 shows a key grip being removable from the control means, FIG. 6, on a larger scale, shows a section along line VI—VI in FIG. 4.

As with the embodiment according to FIGS. 4, 5 the control portion will have a rod or other suitable component for re-setting the studs. Such rod may be permanently built into the body and may be rotated or displaced axially by means of a key of special tool.

FIG. 10 shows a portion of the blocking mechanism pertaining to a vending machine of a slightly modified design, also adapted to distribute bottled beverages.

The necks 40 of bottles 41 extend into notches 42 of a horizontal board 43. There is a blocking member 44 at each notch, being formed as an arcuate arm, rotatable about a vertical axis 45.

In FIG. 10 the left blocking member 44*a* has been brought to open position whereas the other members 44*b, c* rest in blocking position.

For each notch 42 there is an axially displaceable rod 46*a, b, c*—same as rods 34 in FIG. 9—the remote end of which will operate a pin stamp (not shown in FIG. 10). Each rod 46 provided with a transversely directed bracket 47, which extends past the turning axis 45 of the arm 44 at the associated notch 42.

The mounting of each arm is provided with a driving pin 48 located between the pivot axis 45 and the arm, and adapted for cooperation with bracket 47.

When an arm 44 is swung counterclockwise pin 48 will move bracket 47 and its associated rod 46 to the right (as shown in the drawing), and this will cause the associated pin stamp to put a mark on the control portion.

A control portion must not necessarily be mounted upon the room key, but can be formed as a separate element, which however must be provided with means—like a key—so it will open a particular vending machine only.

Figure 6:
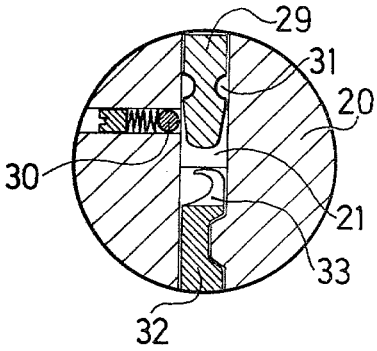

As shown in FIG. 11 the control portion 50 may be formed as an elongate prismatic body having a row of transverse bores 51 in one of its side faces. Each bore houses, as described in connection with FIG. 6, a spring loaded stud, which is axially displaceable in its bore, by action of a pin stamp.

With a suitable breadth of the control portion bores may extend also from the opposite side of the member. In a thick member there may be two superimposed rows of bores.

A rod, similar to rod 32 of FIG. 5, may be insertable in an opening 52, or may be permanently built into the control portion for re-setting the studs. Such built in rod may be rotatable or axially displaceable, and is operable by a special tool, preventing unauthorized re-setting.

The control portion is axially slidable into an opening in the machine, and its front, or inward end is formed as a key bit 52, which, when the control member is brought to the proper position, will set the rods 46 of the blocking members free. Additionally, or as an alternative, the inward end of the control portion may have one or more projecting studs 53, which have to fit into suitable slots.

It is evident that combinations of variously formed key bits 52 and/or studs 53 will provide a great many variations to ensure that it is practically impossible to use a control portion other than with the machine for which it is intended.

The control portion may be attached to the room key 55 by a chain 56, as a pendant, and may carry the name of the hotel, the room number and/or other information as is common in the trade.

What I claim is:

1. In a vending machine having a number of separate components, a blocking member at each compartment which is rotatable between a blocking position for blocking goods placed therein and an open position wherein the goods can be removed, linkage means connected to said blocking member for transferring the rotating movement of said blocking member into an axial movement, an axially moveable pin stamp at the end of each linkage at its end remote from the associated blocking member, means for mounting pin stamps operable from a number of blocking members in close relationship, means for locking said linkages, an opening in said machine, adjacent to said pin stamp mounting means, and formed to permit the introduction therein of a release element for operating said linkage locking means, a control portion at said release element having transverse bores, in number and position mating with the pin stamps in said pin stamp mounting means, and an axially displaceable stud in each of said bores, and means for retaining each of said studs in either of two axial positions, whereby when said blocking means is rotated to said open position, said pin stamp moves axially into its associated bore, thereby axially displacing said stud to provide a visual indication of the purchase of goods.

2. The vending machine according to claim 1, in which the opening in the machine includes a housing for enclosing the control portion of said release element when the latter is introduced into the opening, said housing having guides for the pin stamps.

3. The vending machine according to claim 2, in which said control portion is formed as a cylinder, rigidly connected to a rotatable key, being fitted between its key bit and its grip.

4. The vending machine according to claim 3, in which said linkage locking means is adapted to be rotated part of a revolution by said key, and each linkage comprises an axially displaceable rod and a spring normally biasing said rod towards a position to block a cam which is connected to the associated blocking member, whereby, when said locking means is rotated by said key, each linkage is axially displaced sufficiently far to unblock said cam and, thereby, permit rotation of said blocking member, but not sufficient to move the pin stamps to embossing position.

5. The vending machine according to claim 3, in which the grip of said key is detachably mounted at said cylinder, and includes a rod insertable in a slot in said cylinder, adjacent to the bores containing said studs, and adapted to move said studs from an inward, marking, position to an outer, neutral, position, when being moved along said slot.

6. The vending machine according to claim 1, in which said control member is a substantially prismatic body, being axially slidable into said opening, and carrying key portions performing the release action.

7. The vending machine according to claim 6, in which said prismatic body is provided with a built in rod member adapted to move said studs from an inward, marking, position to an outer, neutral, position, when being rotated, or axially displaced.

* * * * *